US006766649B2

(12) United States Patent
Burlingame

(10) Patent No.: US 6,766,649 B2
(45) Date of Patent: Jul. 27, 2004

(54) PNEUMATIC POWERED DRIVE

(75) Inventor: Michael Burlingame, East Liverpool, OH (US)

(73) Assignee: Lisbon Hoist, Inc., Lisbon, OH (US)

( * ) Notice: Subject to any disclaimer, the term of this patent is extended or adjusted under 35 U.S.C. 154(b) by 0 days.

(21) Appl. No.: 10/163,695

(22) Filed: Jun. 6, 2002

(65) Prior Publication Data

US 2002/0189434 A1 Dec. 19, 2002

Related U.S. Application Data

(60) Provisional application No. 60/297,344, filed on Jun. 11, 2001.

(51) Int. Cl.[7] ..... B66F 19/00; B66D 1/10

(52) U.S. Cl. ..... 60/905; 254/360; 137/884

(58) Field of Search ..... 91/466; 60/493, 60/905; 137/884; 254/360

(56) References Cited

U.S. PATENT DOCUMENTS 3,513,876 A * 5/1970 Tarbox ..... 137/884
3,766,943 A * 10/1973 Murata ..... 137/884
3,840,047 A * 10/1974 Gibbins ..... 137/884
4,566,675 A * 1/1986 Kotone et al. ..... 254/360
5,725,199 A * 3/1998 Yamamoto ..... 254/360
6,189,571 B1 * 2/2001 Hedlund ..... 137/884

* cited by examiner

*Primary Examiner*—Thomas E. Lazo
(74) *Attorney, Agent, or Firm*—Sand & Sebolt

(57) ABSTRACT

An air hoist, also referred to as a winding machine, includes an air motor with a manifold thereon, a valve plate and an operating valve. The air motor includes a reversably rotatable drum about which an elongated load-carrying element, such as a chain or cable, is wound to permit lifting or lowering of a load. The drum is driven in either a clockwise or counterclockwise manner, thereby causing lowering or lifting, by fluid pressure supplied by a pneumatic or air supply. The lowering or lifting is controlled by fluid direction through the manifold, valve plate and operating valve which is controlled by the position of the operating valve. The manifold, valve plate and single operating valve being of a unique design and configuration.

12 Claims, 8 Drawing Sheets

PNEUMATIC POWERED DRIVE

BACKGROUND OF THE INVENTION

1. Technical Field

This invention relates to an improved pneumatic powered drive such as an air hoist using pressurized air to lift or lower a load. The lifting or lowering is controlled by fluid pressure and direction through the manifold, valve plate and operating valve which is controlled by the position of the operating valve causing alignment of various passages. The hoist including a unique air flow passage design defined by the manifold, valve plate and operating valve which when in a certain position causes lifting while in another lowering.

2. Background Information

Air hoists or like devices have been known and used for years. General air hoists are shown in U.S. Pat. Nos. 4,566,675 and 5,725,199. Air hoists, which are often referred to as winding machines, are basically hoists driven by an air motors. The air motors use air to drive a rotatable drive wheel or the like which rotates causing a chain, belt or other drive device wrapped therearound to move. Such air motors are typically operated using manual throttle valves operated by a worker by hand to actuate an air cylinder to control or direct fluid flow in the air motor. The air drives the lifting or lowering.

In U.S. Pat. No. 5,725,199 for instance, the winding machine includes a chain, a winding portion with the chain wound around its outer periphery, and an air motor for rotating the winding portion with high-pressure air supplied from an air supply source. The air motor includes a rotary air motor capable of rotating in normal and reverse directions. An air amount adjustment mechanism is also provided an includes an air supply valve, a first operation unit, and a second operation unit. The first operation is operated so as to rotate the air motor in a normal direction, thereby raising the load; while the second operation is operated so as to rotate the air motor in a reverse direction, thereby lowering the load. The result is a complex structure requiring duplicative parts and passages to accomplish bi-directional operation (that is lifting and lowering).

U.S. Pat. No. 4,566,675 similarly requires multiple, in its case three, throttle valves to perform lifting, lowering and holding. Thus, many air hoists designs exist; however, it is desirous to invent an air hoist of a simplified design which includes only one operating valve.

SUMMARY OF THE INVENTION

Objectives of the invention include providing a new pneumatic powered drive that may be used as an air hoist.

These and other objectives of the invention are obtained by the improved pneumatic powered drive of the present invention including an operating valve with an elongated interior chamber that has a plurality of intersecting valve ports. The operating valve further has a baffle slidable in the elongated chamber by a handle extending outside of the interior chamber. The pneumatic powered drive also includes a valve mount plate with a plurality of passages therein where each passage is aligned with one of the valve ports in the operating valve when the operating valve is mounted on the valve mount plate. The pneumatic powered drive also has a manifold with a plurality of channels each having-a plate end and an air motor end where each plate ends aligns with one of the passages when the valve mount plate is mounted on the manifold. The aligned plurality of passages and channels define a plurality of fluid passage one of which is an inlet fluid passage. The pneumatic powered drive also has an air motor that includes an air inlet connected to an air passage connectable the inlet fluid passage when the manifold is mounted on the air motor. The air motor also includes a plurality of motor ports where each are aligned with a different fluid passage and where the motor ports provide fluid access to a drive chamber in the air motor in which motor shaft is drivable.

BRIEF DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

DESCRIPTION OF THE PREFERRED EMBODIMENT

Figure 1:
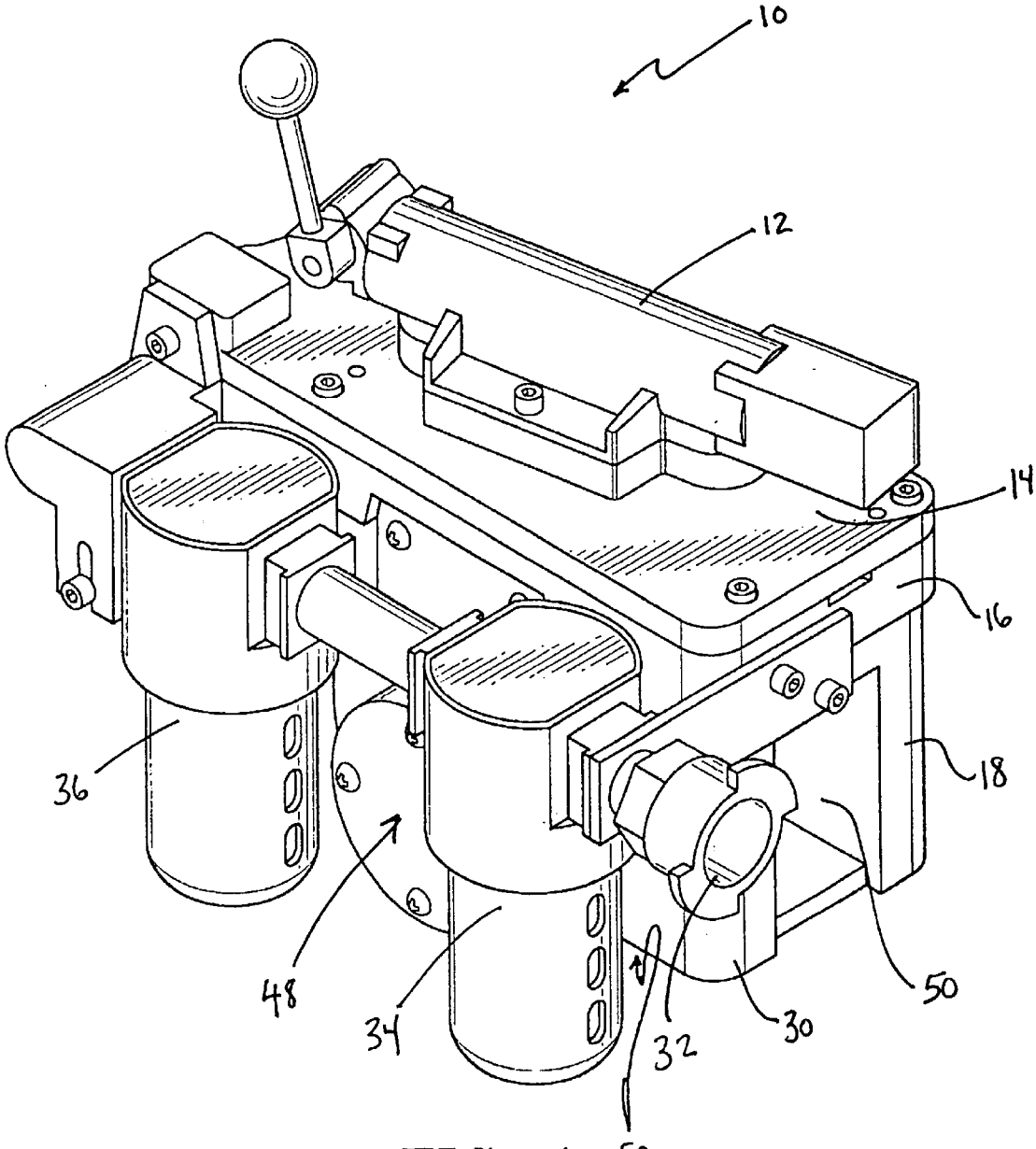
FIG. 1 is an overall view of the pneumatic powered drive of the present invention including an air motor with a manifold, a valve plate and an operating valve.

Referring now to the drawing, the overall arrangement of the preferred embodiment of the pneumatic powered drive 10 is shown in FIG. 1. This new pneumatic powered drive 10 uses a single operating valve 12 fluidly coupled with a valve mount plate 14 fluidly coupled with a manifold 16 to control the air hoist between lifting, neutral and lowering motions. The manifold 16 is attached and fluidly coupled to an air motor 18 which receives pressurized fluid such as air from a pressurized fluid source (not shown).

Air motor 18 as best shown in FIGS. 1 and 5–7 is a body 30 which includes an air inlet 32, an optional air filter 34, an optional air lubricator 36, a first air motor-manifold port 38, a second air motor-manifold port 40, a third air motor-manifold port 42, a fourth air motor-manifold port 44, a fifth air motor-manifold port 46, a drive chamber 48, a first air outlet or exhaust 50, and a second air outlet or exhaust 52.

Figure 4:
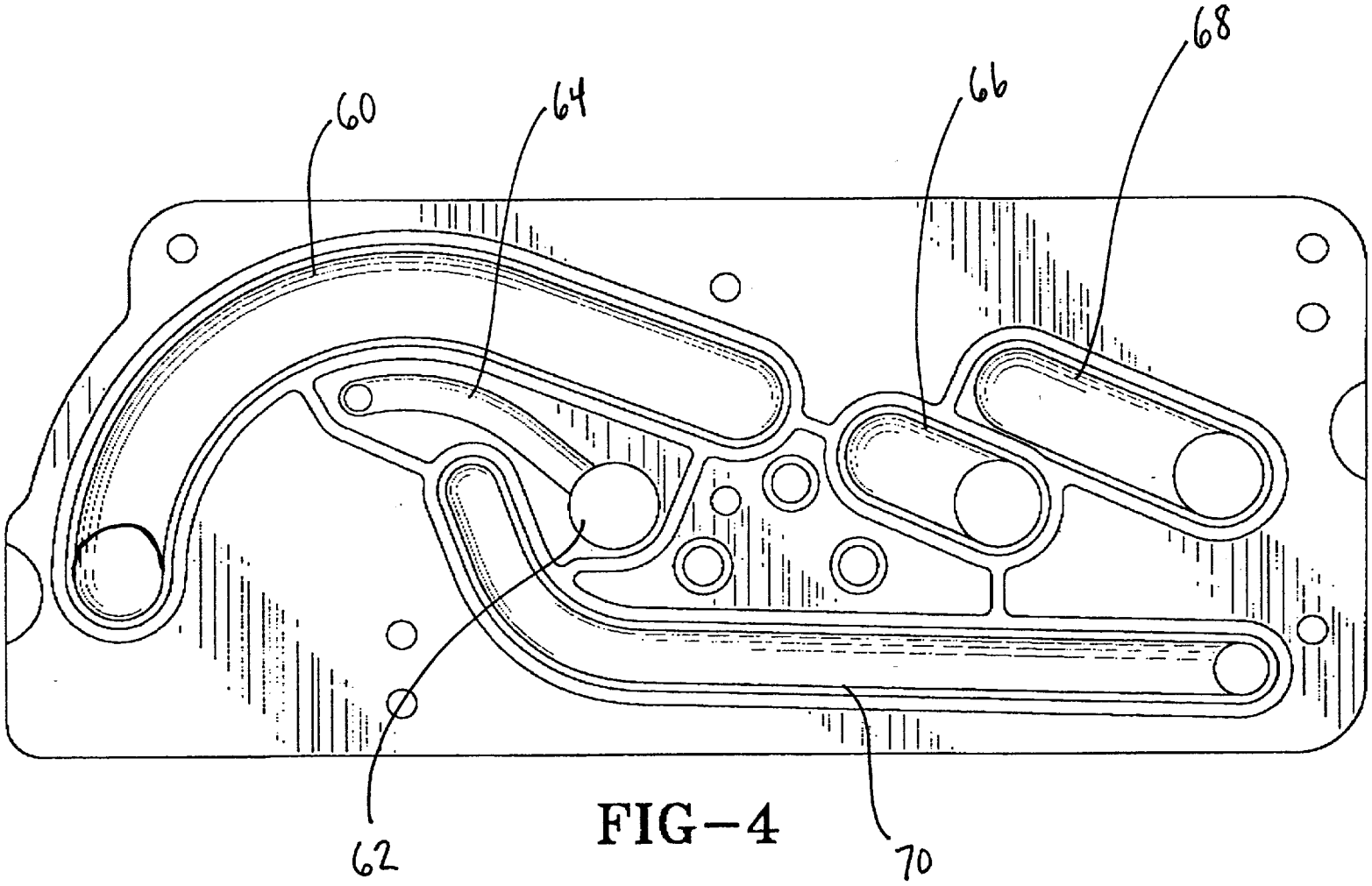
FIG. 4 is a top view of the manifold of the pneumatic powered drive of FIG. 1.
Figure 4A:
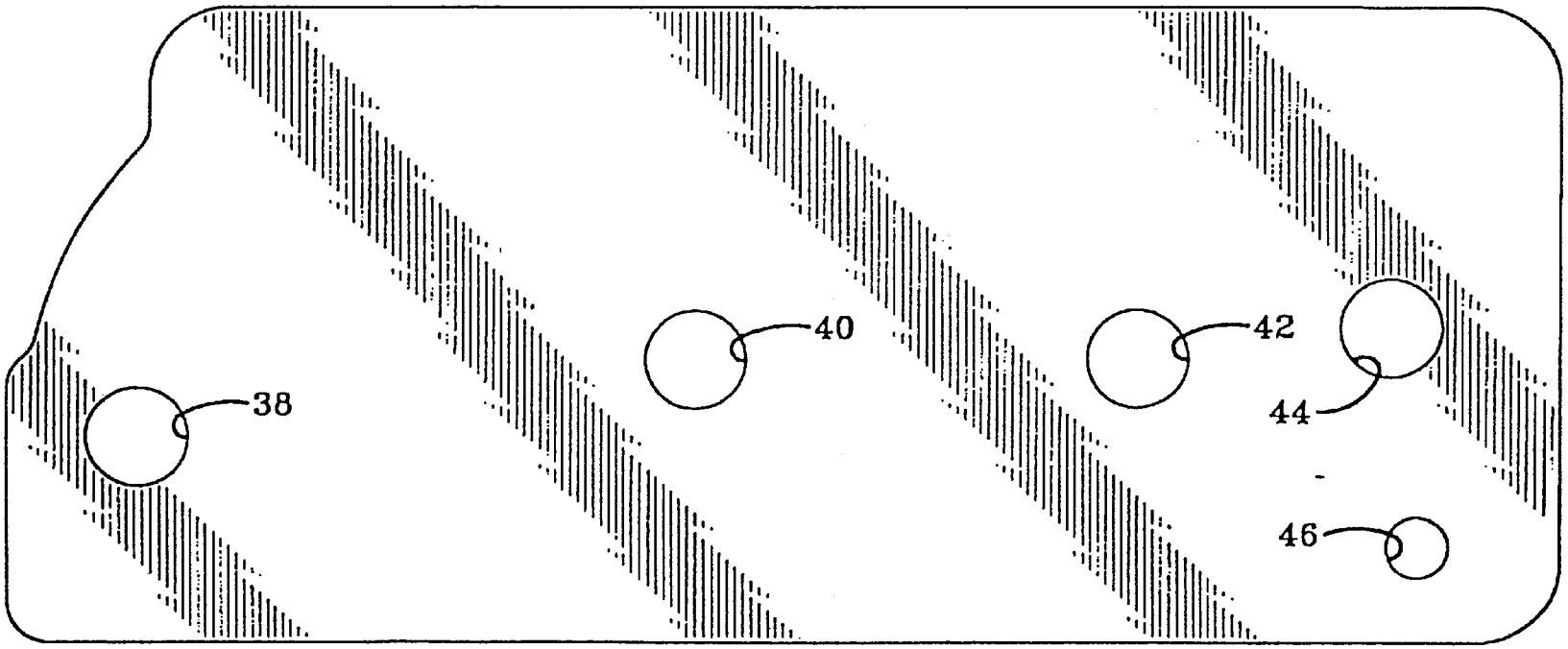
FIG. 4A is a top view of one embodiment of the top surface of the air motor against which manifold seats.

Manifold 16 as best shown in FIGS. 1 and 4 is a rigid plate that is securely attached or integrally molded to a surface of air motor 18 in which ports 38–46 exist. Manifold 16 includes a first manifold channel or passage 60, a second manifold channel or passage 62 with a spoke passage 64 optionally extending therefrom, a third manifold channel or passage 66, a fourth manifold channel or passage 68, and a fifth manifold channel or passage 70.

Figure 3:
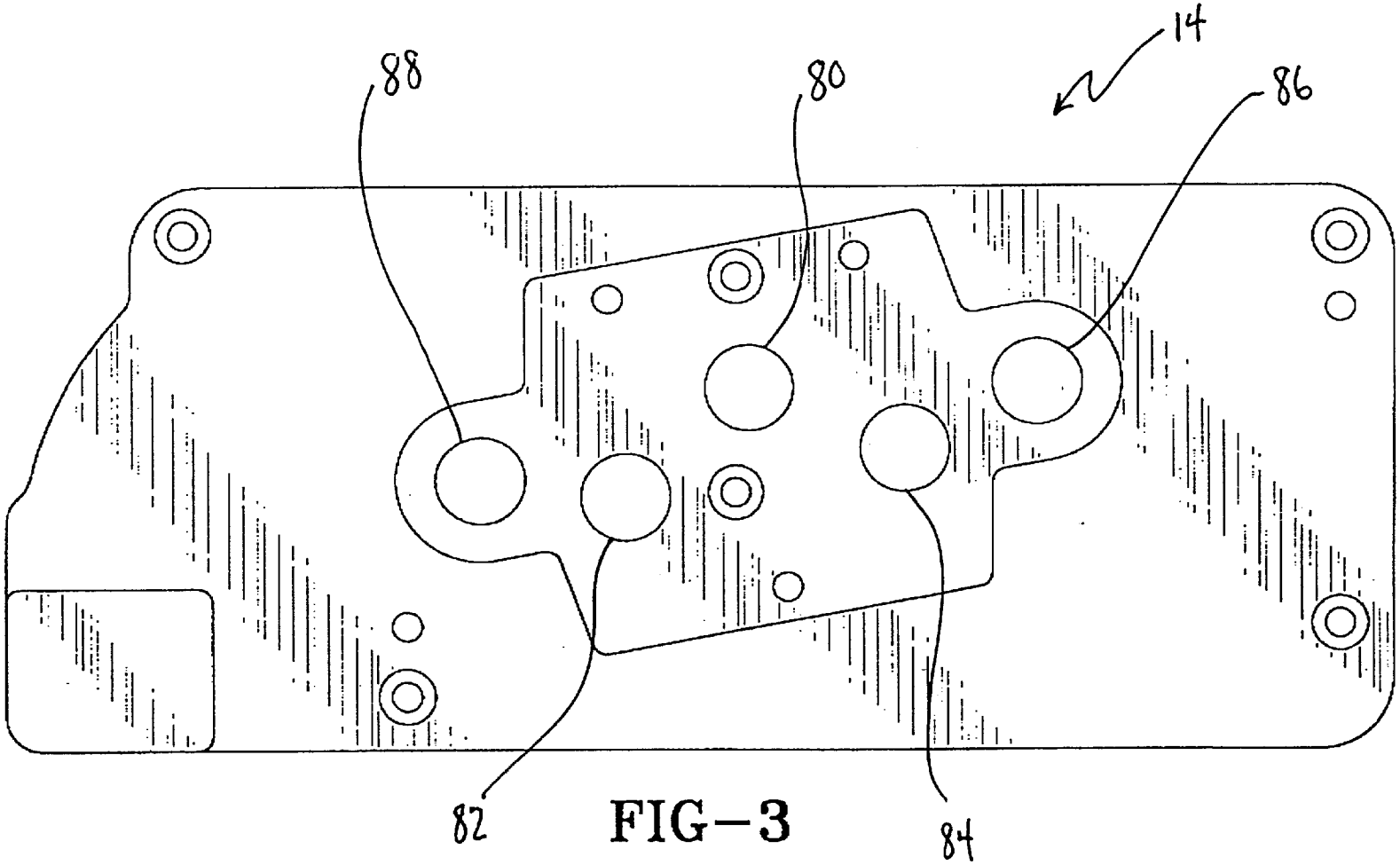
FIG. 3 is a top view of the valve plate of the pneumatic powered drive of FIG. 1.

Valve mount plate 14 as best shown in FIGS. 1 and 3 is a rigid plate that is securely attached to manifold 16 opposite air motor 18. Valve plate 14 includes a first mount plate passage 80, a second mount plate passage 82, a third mount plate passage 84, a fourth mount plate passage 86, and a fifth mount plate passage 88.

Figure 2:
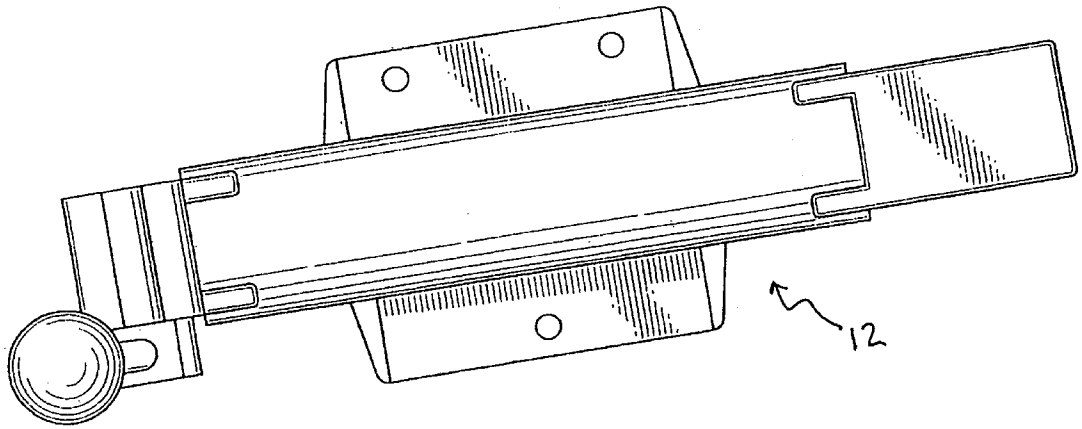
FIG. 2 is a top view of the operating valve of the pneumatic powered drive of FIG. 1.
Figure 2A:
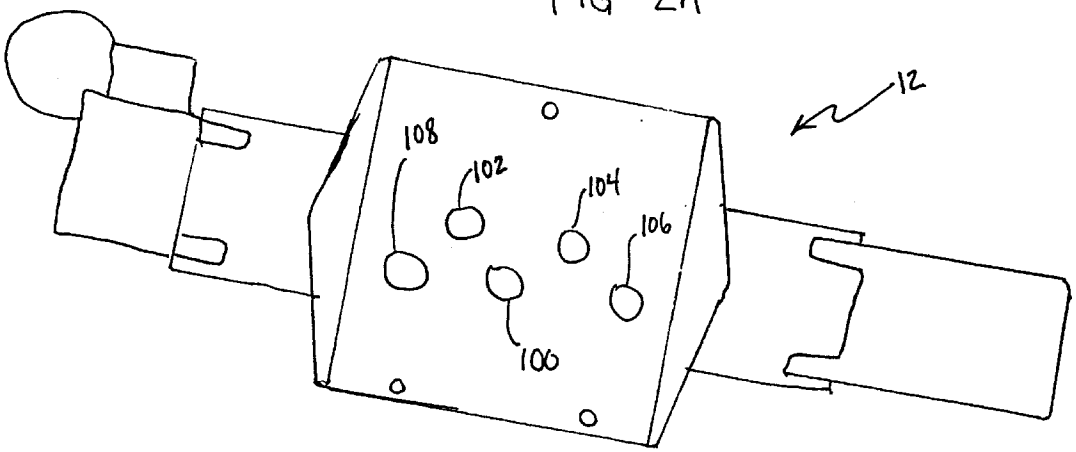
FIG. 2A is a bottom view of the operating valve of the pneumatic powered drive of FIG. 1.

Operating valve 12 as best shown in FIGS. 1 and 2 is an elongated structure that is securely attached to the valve mount plate and includes a first valve port 100, a second valve port 102, a third valve port 104, a fourth valve port 106 and a fifth valve port 108. The operating valve further includes an elongated chamber therein in which a baffle such as a piston sealably slides and extends from and is attached to a handle 120. The valve ports 100–108 all fluidly interconnect to the elongated chamber. The piston slides within the chamber and includes sealable parts and open or fluid flowing parts where the fluid flowing parts are either reduced diameter areas, sections removed from the piston or passages within the piston.

In more detail in one preferred embodiment, the passages or channels of manifold 16 are of specific configurations. First manifold channel or passage 60 is of an arcuate nature as best shown in FIG. 4. Channel 60 is an elongated channel of a cross section that is generally semi-circular except that one end of the channel includes a circular port alignable with port 38. The channel arcs in a ¼ circular manner from the circular port and then at its other end straightens out. The channel, except for the circular port that substantially perpendicularly passes through manifold 16, is planar in nature to the substantially planer manifold 16.

Second manifold channel or passage 62 is a port perpendicularly passing through the planer manifold. The optional spoke passage 64 radially extends from the port-like passage 62 and then arcs slightly until it concludes in a port perpendicular to the planar manifold which is connected to a braking system. As a result, when pressurized air passes through the passage 62, the brake spoke also receives the air and communicates with an air or pneumaitc actuated braking system.

Third manifold channel or passage 66 is a short slot that is planar with the manifold, and includes a port perpendicular to the manifold at one end thereof. The cross section of the slot is semi-circular.

Fourth manifold channel or passage 68 is very similar to passage 66 except that it is a longer slot that is planar with the manifold, and includes a port perpendicular to the manifold at one end thereof. The cross section of the slot is semi-circular.

Fifth manifold channel or passage 70 is arcuate in nature. Channel 70 is an elongated channel of a cross section that is generally semi-circular (but of a lesser diameter than the other channels) except that one end of the channel includes a circular port alignable with port 46. The channel arcs in less than a ¼ circular manner at one end and then straightens out for a long leg that concludes with the circular port alignable with port 46. The channel, except for the circular port that substantially perpendicularly passes through manifold 16, is planar in nature to the substantially planer manifold 16.

Numerous other ports or the like are within the manifold as shown in the Figures. These are necessary for part connection purposes such as connecting the manifold to the air motor. The manifold also includes seal grooves along the periphery of every channel 60–70 for the purpose of receiving a seal when the valve plate is engaged therewith. This provides for sealed connection therebetween. Such sealing arrangement is also provided between the other key parts such as the operating valve and the valve plate.

In assembly, operating valve 12 is securely attached to and aligned with valve mount plate 14 which in turn is securely attached to and aligned with manifold 16 which is securely attached to and aligned with the air motor 18. As a result, first air motor-manifold port 38 is fluidly coupled to first manifold passage 60 which is fluidly coupled to first mount plate passage 80 which is fluidly coupled to first valve port 100 defining an input or first fluid passage P1 to the operating valve. Four other fluid passages are similarly defined, namely a second fluid passage P2 defined by the fluid connection of second air motor-manifold port 40, second manifold passage 62, second mount plate passage 82, and second valve port 102; a third fluid passage P3 defined by the fluid connection of third air motor-manifold port 42, third manifold passage 66, third mount plate passage 84, and third valve port 104; a fourth fluid passage P4 defined by the fluid connection of fourth air motor-manifold port 44, fourth manifold passage 68, fourth mount plate passage 86, and fourth valve port 106; and a fifth fluid passage P5 defined by the fluid connection of fifth air motor-manifold port 46, fifth manifold passage 70, fifth mount plate passage 88, and fifth valve port 108.

Figure 5:
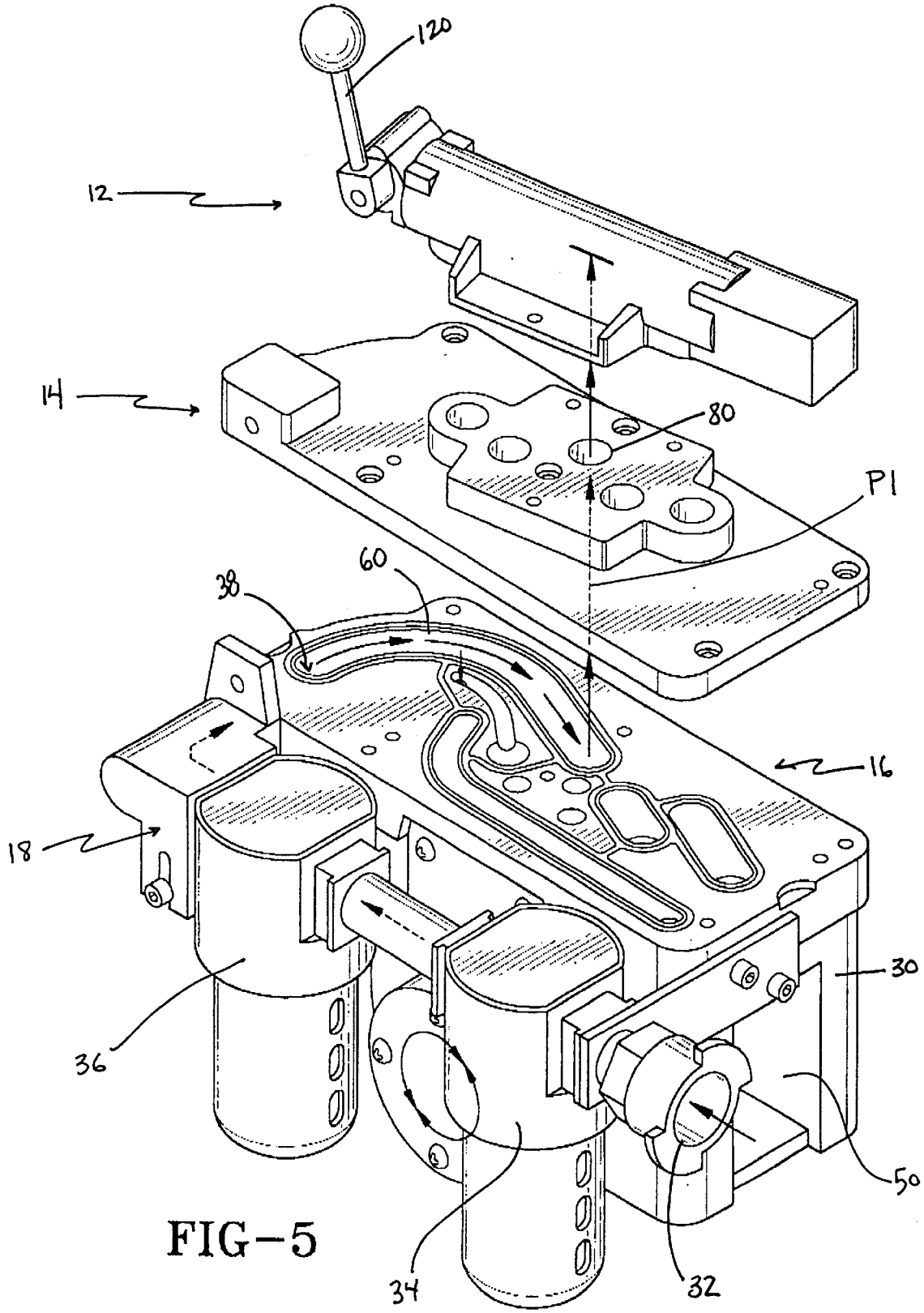
FIG. 5 is an exploded view of the pneumatic powered drive of FIG. 1 in a neutral position.

In operation, when the operating valve 12 is in a neutral or braked position, the handle 120 is in a resting or center position as shown in FIG. 5. Air provided to air inlet 32 proceeds into air filter 34, air lubricator 36 and into the input or first fluid passage P1 (first air motor-manifold port 38, first manifold passage 60, first mount plate passage 80, and first valve port 100). Once the air reaches first valve port 100 it is contained, stopped or otherwise blocked from further advancement by a piston, gate or other structure within operating valve 12. In addition, a brake is in its default position which is always an applied position as a safety feature. As a result, the motor shaft or other drive device such as drive wheel or the like (so long as it is drivable by air pressure) is not driven or rotated and thus any elongated load carrying element such as a chain, belt, or other drive device wrapped therearound is not advanced so its load thereon is not lifted or lowered.

Figure 6:
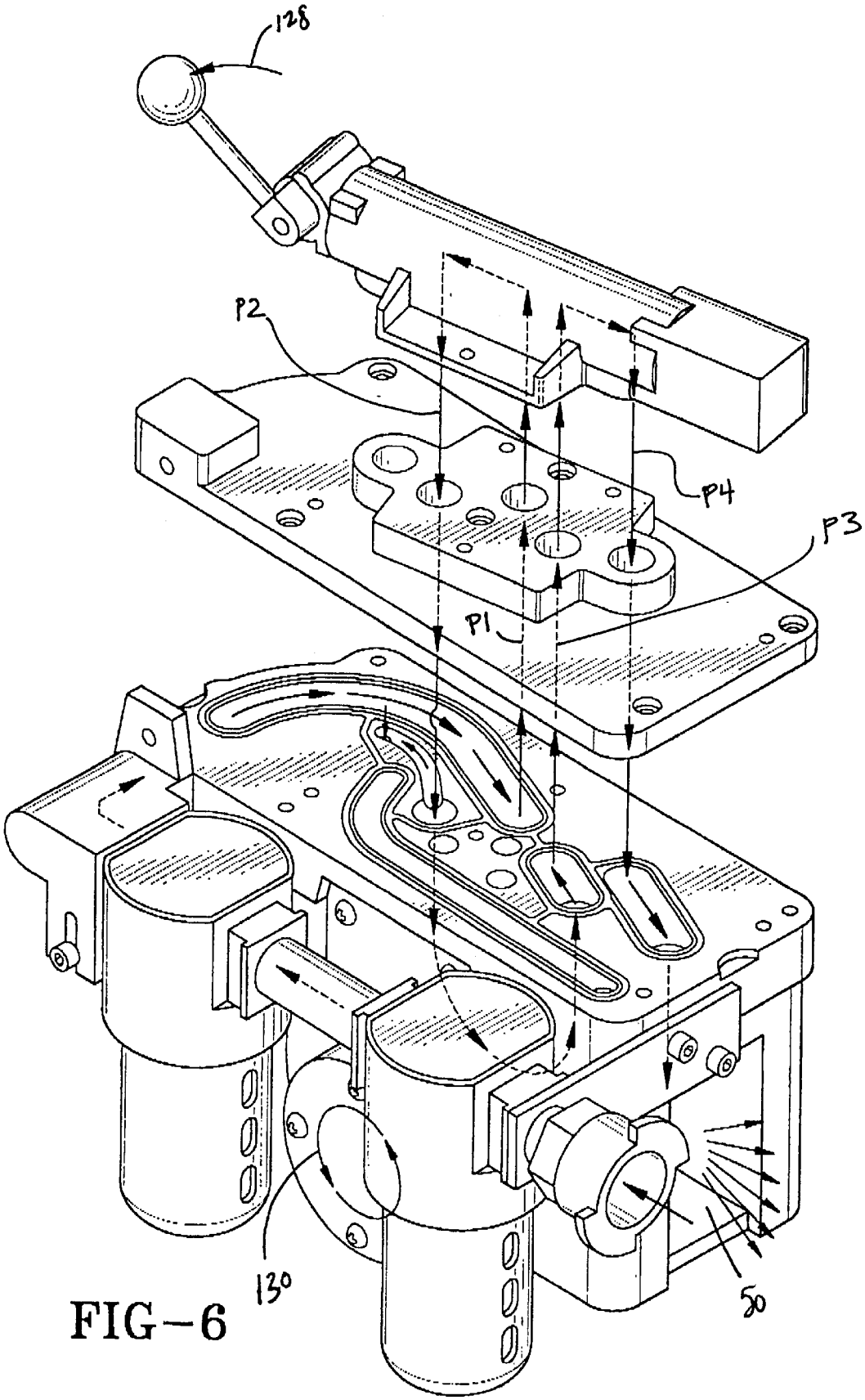
FIG. 6 is an exploded view of the pneumatic powered drive of FIG. 1 in a lifting or up travel position.

When the operating valve 12 is in an up travel position, the handle 120 is in a pulled back position as shown in FIG. 6 by arrow 128. Air provided to air inlet 32 proceeds into air filter 34, air lubricator 36 and into the input or first fluid passage P1 (first air motor-manifold port 38, first manifold passage 60, first mount plate passage 80, and first valve port 100). Once the air reaches first valve port 100 it is directed by the piston, gate or other structure within operating valve 12 into and through the second fluid passage P2 (second air motor-manifold port 40, second manifold passage 62, second mount plate passage 82, and second valve port 102). Once the air reaches second air motor-manifold port 40, it is released into the drive chamber 48 on a first side of the motor shaft thereby driving it in an up travel direction or counterclockwise as shown in FIG. 6 by arrow 130. In addition, as the air passed through second manifold passage 62, a small portion is directed into passage 64 thereby releasing the air brake fluidly connected thereto. The air continues out of the drive chamber 48 and into third fluid passage P3 (third air motor-manifold port 42, third manifold passage 66, third mount plate passage 84, and third valve port 104) where once it reaches third valve port 104 it is directed by the piston, gate or other structure within operating valve 12 into and through the fourth fluid passage P4 (fourth air motor-manifold port 44, fourth manifold passage 68, fourth mount plate passage 86, and fourth valve port 106). After the air passes through this fourth fluid passage P4 and specifically through fourth air mount-manifold port 44, it is released into the atmosphere at first air outlet 50. As long as the handles remains pulled back and the operating valve open as defined above in this paragraph, the motor shaft is rotated causing lifting or up travel. As soon as the handle 120 is released, it springs back to the neutral position and all travel stops.

Figure 7:
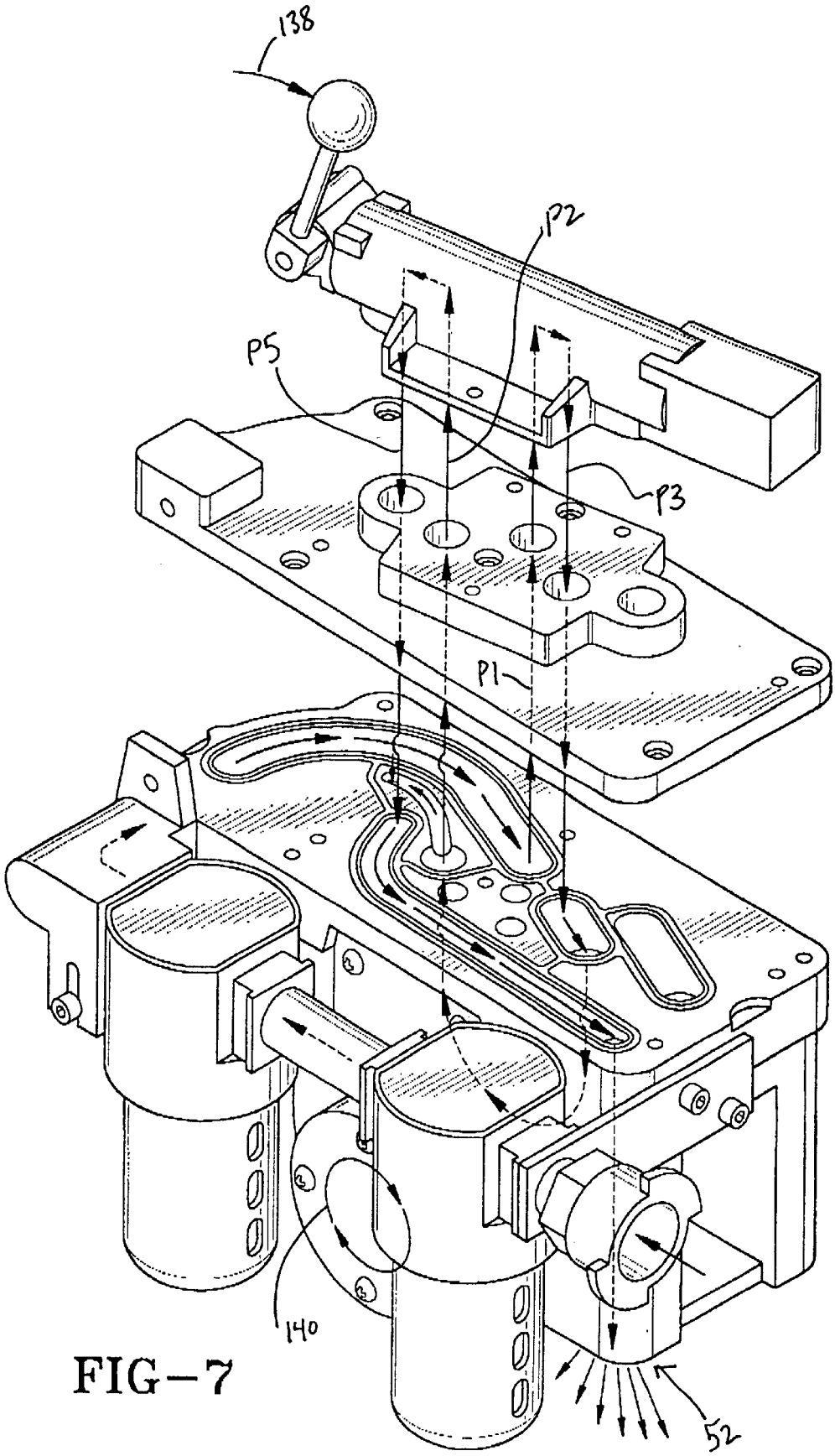
FIG. 7 is an exploded view of the pneumatic powered drive of FIG. 1 in a lowering or down travel position.

When the operating valve 12 is in a down travel position, the handle 120 is in a pushed forward position as shown in FIG. 7 by arrow 138. Air provided to air inlet 32 proceeds into air filter 34, air lubricator 36 and into the input or first fluid passage P1 (first air motor-manifold port 38, first manifold passage 60, first mount plate passage 80, and first valve port 100). Once the air reaches first valve port 100 it is directed by the piston, gate or other structure within operating valve 12 into and through the third fluid passage P3 (third air motor-manifold port 42, third manifold passage 66, third mount plate passage 84, and third valve port 104). Once the air reaches third air motor-manifold port 42, it is released into the drive chamber 48 on a second side of the motor shaft thereby driving it in a down travel direction or clockwise as shown in FIG. 7 by arrow 140. The air continues out of the drive chamber 48 and into second fluid passage P2 (second air motor-manifold port 40, second manifold passage 62, second mount plate passage 82, and second valve port 102). As the air passed through second manifold passage 62, a small portion is directed into passage 64 thereby releasing the air brake fluidly connected thereto. Once the air reaches second valve port 102 it is directed by the piston, gate or other structure within operating valve 12 toward the fifth fluid passage P5 (fifth air motor-manifold port 46, fifth manifold passage 70, fifth mount plate passage 88, and fifth valve port 108). After the air passes through this fifth fluid passage P5 and specifically through fifth air mount-manifold port 46, it is released into the atmosphere at second air outlet 52. As long as the handles remains pushed forward and the operating valve open as defined above in this paragraph, the motor shaft is rotated causing lowering or down travel. As soon as the handle 120 is released, it springs back to the neutral position and all travel stops.

As is readily apparent from the above description, the pneumatic powered drive 10 is operated between a lifting, neutral or braked, and lowering action by only one operating valve 12 using a unique operating valve construction fluidly connected to a unique valve mount 14 and manifold 16 defining unique fluid passages therein.

Accordingly, the improved air hoist is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved bat and ball game is constructed and used, the characteristics of the construction, and the advantageous, new and useful results obtained; the new and useful structures, devices, elements, arrangements, parts and combinations, are set forth in the appended claims.

I claim:

1. A pneumatic powered drive comprising:

an operating valve including an elongated interior chamber with a plurality of intersecting valve ports, the operating valve further including a baffle slidable therein by a handle extending outside of the interior chamber;

a valve mount plate having a plurality of passages therein, each passage being aligned with one of the valve ports in the operating valve where the operating valve is mounted on the valve mount plate;

a manifold having a plurality of channels each having a plate end and an air motor end, each plate ends aligning with one of the passages when the valve mount plate is mounted on the manifold, whereby the aligned plurality of passages and channels define a plurality of fluid passage one of which is an inlet fluid passage; and an air motor including an air inlet connected to an air passage connectable to the inlet fluid passage when the manifold is mounted on the air motor, the air motor also including a plurality of motor ports where each are aligned with a different fluid passage and where the motor ports provide fluid access to a drive chamber in the air motor in which the motor shaft is drivable.

2. The pneumatic powered drive of claim 1 wherein the plurality of passages is five, and the plurality of channels is five.

3. The pneumatic powered drive of claim 1 wherein the baffle is a slidable piston.

4. The pneumatic powered drive of claim 3 wherein the piston includes at least one of reduced diameter areas, removed sections, and fluid flow passages through the piston.

5. The pneumatic powered drive of claim 4 wherein the piston includes a first fluid flow passage and a second fluid flow passage, and further includes seals to prohibit fluid flow between the fluid flow passages.

6. The pneumatic powered drive of claim 5 wherein the plurality of passages, the plurality of channels, and plurality of motor ports align to define the inlet fluid passage, a second fluid passage, a third fluid passage, a fourth fluid passage, and a fifth fluid passage.

7. The pneumatic powered drive of claim 6 wherein the piston has a first, second and third position within the operating valve, whereby the first position is defined as alignment of the first fluid flow passage with the inlet fluid passage and the second fluid passage, while the second fluid flow passage is aligned with the third fluid passage and the fourth fluid passage, the second position is defined as alignment of the first fluid flow passage with the inlet fluid passage and the third fluid passage, while the second fluid flow passage is aligned with the second fluid passage and the fifth fluid passage, and the third position is any other position of the piston within the operating valve.

8. The pneumatic powered drive of claim 7 wherein the first position results in fluid being provided to the drive chamber to cause counterclockwise rotation of the motor shaft, while the second position results in fluid being provided to the drive chamber to cause clockwise rotation of the motor shaft, and the third position causes no rotation at all.

9. A pneumatic powered drive comprising:

an operating valve including an elongated interior chamber with a plurality of intersecting valve ports including an inlet valve port, a second valve port, a third valve port, a fourth valve port and a fifth valve port, the operating valve further including a baffle slidable therein by a handle extending outside of the interior chamber for allowing fluid flow between selected valve ports; and an air motor including an air inlet connected to a first fluid passage fluidly coupled to the inlet valve port, the air motor further including a second fluid passage extending between the second valve port and a drive chamber in the air motor in which the rotatable drive shaft is positioned, and a third fluid passage extending between the third valve port and the drive chamber where the second and third fluid passages enter the drive chamber at differing positions such that one forces clockwise rotation of the drive shaft while the other forces counterclockwise rotation, and the air motor further including a fourth fluid passage extending between the fourth valve port and the atmosphere, and a fifth fluid passage extending between the fifth valve port and the atmosphere.

10. The pneumatic powered drive of claim 9 wherein the baffle has a first, second and third position within the operating valve, whereby the first position is defined as alignment of the first fluid passage with the second fluid passage, and the third fluid passage with the fourth fluid passage, the second position is defined as alignment of the first fluid passage with the third fluid passage, and the second fluid passage with the fifth fluid passage, and the third position is any other position of the baffle within the operating valve.

11. The pneumatic powered drive of claim 10 wherein the first position results in fluid being provided to the drive chamber to cause counterclockwise rotation of the motor shaft, while the second position results in fluid being provided to the drive chamber to cause clockwise rotation of the motor shaft, and the third position causes no rotation at all.

12. A method of driving a pneumatic powered drive comprising:

providing an air source:

providing air to an air motor including a motor shaft, a manifold with fluid chambers therein, and an operating valve;

for lifting, actuating the operating valve from a first position to a second position thereby opening a first complete fluid passage from the air source to the air motor causing rotational movement of the motor shaft in a first rotational direction, whereby once lifting is no longer desired the operating valve is released and defaults back to the first position; whereby the first complete fluid passage is defined as alignment of a first fluid flow passage with an inlet fluid passage and a second fluid passage, while the second fluid flow passage is aligned with a third fluid passage and a fourth fluid passage, and for lower, actuating the operating valve from a first position to a third position thereby opening a second complete fluid passage from the air source to the air motor causing rotation movement of the motor shaft in a second rotational direction, whereby once lowering is no longer desired the operating valve is released and defaults back to the first position; whereby; the second complete fluid passage is defined as alignment of the first fluid flow passage with the inlet fluid passage and the third fluid passage, while the second fluid flow passage is aligned with the second fluid passage and a fifth fluid passage.

* * * * *